US005149103A

United States Patent [19]

Ross

[11] Patent Number: 5,149,103

[45] Date of Patent: Sep. 22, 1992

[54] WORD EXTRACTING WORD GAME AND METHOD

[76] Inventor: Alice A. Ross, 2131 St. Lukes La., Baltimore, Md. 21207

[21] Appl. No.: 480,652

[22] Filed: Feb. 15, 1990

[51] Int. Cl.[5] ..... A63F 9/18

[52] U.S. Cl. ..... 273/432; 273/272

[58] Field of Search ..... 273/240, 241, 242, 243, 273/265, 272, 299, 1 R, 430, 432; 434/167, 172

[56] References Cited

U.S. PATENT DOCUMENTS

| | | | |
|---|---|---|---|
| 3,195,895 | 7/1965 | Kropinski | 273/240 |
| 3,463,487 | 8/1969 | Tepper | 434/167 X |
| 3,746,342 | 7/1973 | Fine | 273/240 |
| 4,340,231 | 7/1982 | Cammarata | 273/243 |
| 4,350,342 | 9/1982 | Barulich | 273/240 |
| 4,466,614 | 8/1984 | Bachman et al. | 273/272 X |
| 4,923,199 | 5/1990 | Hahn | 273/299 |

*Primary Examiner*—Paul E. Shapiro
*Assistant Examiner*—William E. Stoll
*Attorney, Agent, or Firm*—Longacre & White

[57] ABSTRACT

A word game wherein known words are extracted from the left to right letter order of randomly selected known words. The random words are supplied from a word supply, and players are awarded points on the basis of the number of correctly extracted words. The game is won by a player accumulating a preselected point total.

6 Claims, 1 Drawing Sheet

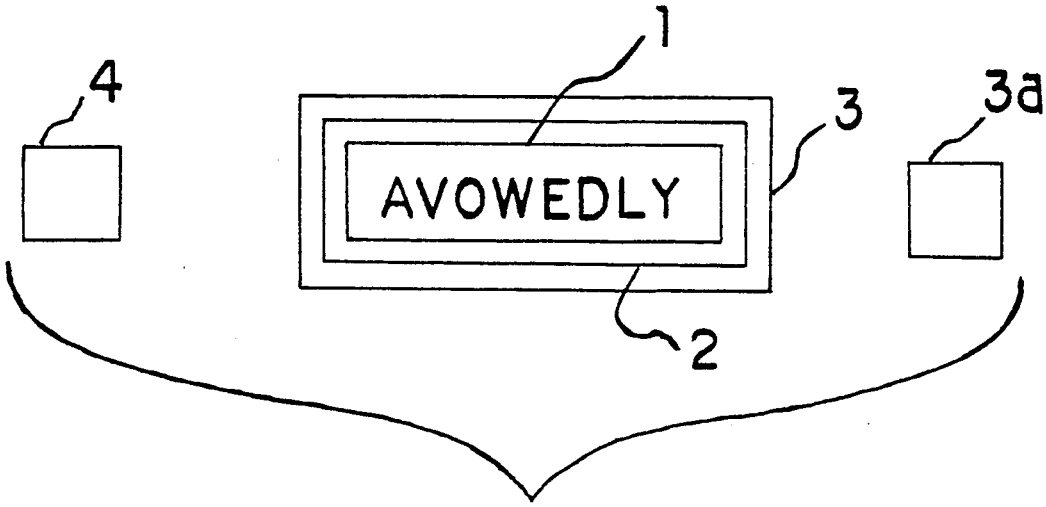
1
4
3
3a
AVOWEDLY
2

WORD EXTRACTING WORD GAME AND METHOD

FIELD OF THE INVENTION

The present invention relates to the field of word games. Specifically, the invention relates to a word game wherein a player identifies words existing within the particular letter order of selected words.

BACKGROUND OF THE INVENTION

The prior art includes many types of word games wherein players attempt to create known words from randomly selected or provided letters or combinations of letters. To win these games, the creation of words results in a point tally commensurate with the assessed difficulty of creating known words from the selected or provided combination of letters.

There are no particular disadvantages to the prior word games with the possible exception that the player with the superior knowledge of spelling, or superior word knowledge generally, will ultimately win the game. Since the letters are usually supplied in a random format, word creation is emphasized over word identification.

In the word game according to the present invention, word identification is the basis of the contest. Thus even persons with a limited word knowledge, or a more limited word knowledge than the other competitors, can be prompted into higher scores by simply recognizing familiar words by sight or sound, i.e., hearing the selected word pronounced.

SUMMARY OF THE INVENTION

The word game according to the present invention is played by a group of two or more players. A known word is randomly selected, and a previously chosen first player initiates the game. From the particular letter order of the selected word, the player attempts to adduce all other known words existing within the letter order (left to right) of the selected word. Points are awarded for the number of words identified. If a word is incorrectly identified, ie, it is not a known word, the player forfeits all points awarded for the correctly identified words in that round of play.

A score card or board is maintained to track the scores of the various players. A preselected upper limit of points is chosen so that a winner may be determined, ie, the first player to reach the preselected total.

BRIEF DESCRIPTION OF THE DRAWINGS

The sole FIGURE is a diagrammatic representation of the game according to the invention.

DETAILED DESCRIPTION OF THE PREFERRED EMBODIMENT

To play the word game according to the present invention, the following rules and methods apply.

A group of two or more players is selected. From among the group, a first player to start the game is selected, the remaining players being assigned turns after the initiating player.

Referring to the sole FIGURE, a word is randomly selected from a stack or other supply 2 of printed words (The word supply may be stored in an electronic database 3 and be provided on a CRT if the game is in video format). Upon reading the word for the first time, the initiating player starts a timer 4 which allots a preselected amount of time for the player to identify known words existing within the left to right letter order of the letters of the selected word. The timer may be set to different periods of time to further challenge players of greater skill. For example, where adults may require only 30 seconds, children may require up to 1 minute of playing time per round.

When the timer has indicated that the preselected period of time has expired, the initiating player ceases identifying words. the words identified in the time period are then counted for scoring purposes. If a word is not a known word (in whatever the selected language is), another player may challenge the authenticity of the suspect word. If the word is incorrect, the player who incorrectly identified the word forfeits the points awarded for that particular round.

On the other hand, if the word that is challenged is in fact correct, the player who identified the word is allowed to add an "s" to the end of the originally selected word and have an additional round of play to identify even more words. If an "s" cannot be properly added to the originally selected base word, the player may either select another word from the word supply, or may save a word draw for a later round.

The foregoing sequence of play is repeated for each player subsequent to the initiating player in consecutive order until each member of the group of players has had an opportunity to play that round.

A bonus point system may also be used with the word game according to the present invention. The first player to reach preselected scoring plateaus, i.e., 50 to 100 points, may receive extra points or a free word draw. A player extracting 10 or more words from a single randomly selected word in a round may be awarded bonus points or an extra word draw. These word draws may be used by the player at any time during their play during a round, i.e., if a player has lost all points for a play owing to a correct word challenge, the player may elect to use a previously awarded extra word draw to recoup some points for the round of play.

An example of play according to the present invention is shown below.

| Example: Random word AVOWEDLY (timer started) | | | | | |
|---|---|---|---|---|---|
| 1. a | 2. avo | 3. avow | 4. vow | 5. avowed | 6. ow |
| 7. owe | 8. owed | 9. we | 10. wed | | |
| Timer stopped. | | | | | |

In this example, the player is awarded a predetermined point total for each known word, and may be awarded an extra word draw for extracting 10 or more words. The score is then entered into a score keeping medium or device, i.e., peg board, sheet of paper, Data Base Accumulator etc., and a next player is allowed to play the round.

The word game according to the present invention may be used for both instructional and entertainment purposes. For example, the game might be played in foreign languages to the players when foreign language skills are being taught. The game may also be used for increasing or expanding the vocabulary of players where the game language is the players' first language. Finally, the game may simply be used as a diversion for entertainment purposes.

The game may be provided in kit form, i.e., including peg boards, scoring sheets, and word supplies for various skill levels, or may be provided in instructional sheet form only, i.e., only rules and instructions. The game may also be provided in computer form for various computer applications, and may even be provided in a format where a single player may simply challenge a score keeper to a game, and play against the clock to accumulate points as rapidly as possible.

The foregoing is a description of the word game according to the present invention, which is claimed in the claims appended hereto. The claims are intended to include in their scope all modifications to the game which may occur to one of ordinary skill within the word game art.

I claim:

1. A method of playing a word game comprising the steps of:

selecting a group of players;

selecting an initiating player from the group of selected players;

randomly selecting a known word from a word supply for viewing by the initiating player;

initiating a timer for a preselected time period;

identifying and recording known words which already exist within the left to right letter order of the randomly selected known word by the initiating player, and ceasing such identifying and recording when the preselected time period has expired;

awarding and recording points based on the number of such known words correctly identified within the randomly selected known word;

repeating the foregoing steps by the remaining players from said group of players until a preselected point total of the recorded points is reached by at least one of the group of players.

2. A method of playing a word game as recited in claim 1, comprising the further step of:

challenging the authenticity of one or more of the identified and recorded words.

3. A method of playing a word game as recited in claim 2, comprising the further step of:

awarding or substracting points from the initiating player on the basis of the validity of the authenticity challenge.

4. A method of playing a word game as recited in claim 1, wherein:

the word supply is stored in an electronic database, and the points and point totals are recorded in a tabular electronic database.

5. A method of playing a game comprising the steps of:

a) selecting a group of players to play the game, thereby defining a beginning of the game;

b) having each respective player in the group take a turn at the game;

wherein, for the turn of each respective player, the method comprises the steps c) through h) of:

c) selecting a known word from a word supply for viewing by the respective player, wherein the selected known word defines a left to right letter sequence;

d) initiating a timer to define a beginning of a time period;

e) having the respective player perform the step of: identifying and recording recognizable known words which already exist within the left to right letter sequence;

f) terminating the identifying and recording step of the respective player upon expiration of the time period defined by the timer;

g) awarding points for each such recognizable, exisiting known word identified and recorded from within the left to right letter sequence by the respective player; and h) determining a point total for the respective player, wherein the point total is defined as a mathematical sum of all points awarded on the basis of such recognizable, existing known words which have been identified and recorded by the respective player since the beginning of the game;

and wherein the game further comprises the steps of:

i) repeating the steps c) through h) for each respective player until at least one of the group of players reaches a predetermined point total; and j) determining a winner to the game, based on the point totals of each of the group of players, when the predetermined point total is reached by at least one of the group of players.

6. A method of playing a game as recited in claim 5 wherein the step g) of awarding points further comprises:

awarding bonus points to each respective player who identifies and records ten or more recognizable, existing known words from within the left to right letter sequence of the selected known word.

* * * * *